US008542082B2

(12) United States Patent
Gao et al.

(10) Patent No.: US 8,542,082 B2
(45) Date of Patent: Sep. 24, 2013

(54) HIGH-IMPEDANCE LINE AND DETECTING SYSTEM HAVING THE SAME

(75) Inventors: Xu Gao, Beijing (CN); Zhi-Jun Zhang, Beijing (CN); Zheng-He Feng, Beijing (CN); Steven-Philip Marcher, Beijing (CN); Zhan Li, Beijing (CN); Yong Yan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 747 days.

(21) Appl. No.: 12/782,822

(22) Filed: May 19, 2010

(65) Prior Publication Data

US 2011/0102113 A1 May 5, 2011

(30) Foreign Application Priority Data

Oct. 30, 2009 (CN) ..... 2009 1 0110162

(51) Int. Cl.
*H01P 1/00* (2006.01)
*H01P 3/00* (2006.01)

(52) U.S. Cl.
USPC ..... 333/245; 333/236

(58) Field of Classification Search
USPC ..... 333/236, 237, 24 R, 238, 245, 246
See application file for complete search history.

(56) References Cited

U.S. PATENT DOCUMENTS

| | | | | |
|---|---|---|---|---|
| 3,761,842 | A * | 9/1973 | Gandrud | 333/1 |
| 5,113,159 | A | 5/1992 | Adriaenssens et al. | |
| 5,774,789 | A * | 6/1998 | van der Kaay et al. | 455/16 |
| 5,939,952 | A * | 8/1999 | Noda et al. | 333/1 |
| 6,222,129 | B1 * | 4/2001 | Siekierka et al. | 174/113 R |
| 6,504,246 | B2 * | 1/2003 | Roth et al. | 257/750 |
| 6,625,682 | B1 * | 9/2003 | Simon et al. | 710/305 |
| 7,271,985 | B1 * | 9/2007 | Buhler et al. | 360/245.9 |
| 8,119,919 | B2 * | 2/2012 | Tagi et al. | 174/254 |
| 2009/0085706 | A1 | 4/2009 | Baarman et al. | |
| 2009/0237183 | A1 | 9/2009 | Chen et al. | |

FOREIGN PATENT DOCUMENTS

| | | |
|---|---|---|
| EP | 0400885 | 12/1990 |
| GB | 380101 | 9/1932 |
| TW | 207834 | 6/1993 |
| TW | M294675 | 7/2006 |
| TW | 200938017 | 9/2009 |
| TW | 200941937 | 10/2009 |

OTHER PUBLICATIONS

Tables of AWG wire sizes, used since 1857, http://en.wikipedia.org/wiki/American_wire_gauge.*

* cited by examiner

*Primary Examiner* — Dean O Takaoka
*Assistant Examiner* — Alan Wong
(74) *Attorney, Agent, or Firm* — Altis & Wispro Law Group, Inc.

(57) ABSTRACT

A high-impedance line includes a plurality of windings successively arranged. Each of the windings includes an upper portion and a lower portion parallel to the upper portion. The upper portions of each of the windings are electrically connected to the lower portions of adjacent windings. A resistance unit electrically connected between every two adjacent windings.

16 Claims, 7 Drawing Sheets

HIGH-IMPEDANCE LINE AND DETECTING SYSTEM HAVING THE SAME

CROSS-REFERENCE

This application claims all benefits accruing under 35 U.S.C. §119 from China Patent Application No. 200910110162.X, filed on Oct. 30, 2009 in the China Intellectual Property Office, the disclosure of which is incorporated herein by reference.

BACKGROUND

1. Technical Field

The present disclosure relates to a high-impedance line and a detecting system having the same.

2. Description of Related Art

Generally, a high-impedance line configured for shielding high frequency signals includes two high-impedance transmission lines parallel to each other. The high-impedance transmission lines are formed by spraying several high impedance materials such as ferrite and silicon repeatedly. Thus, a cost of the high-impedance line is increased.

What is needed therefore, is a high-impedance line with low cost.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
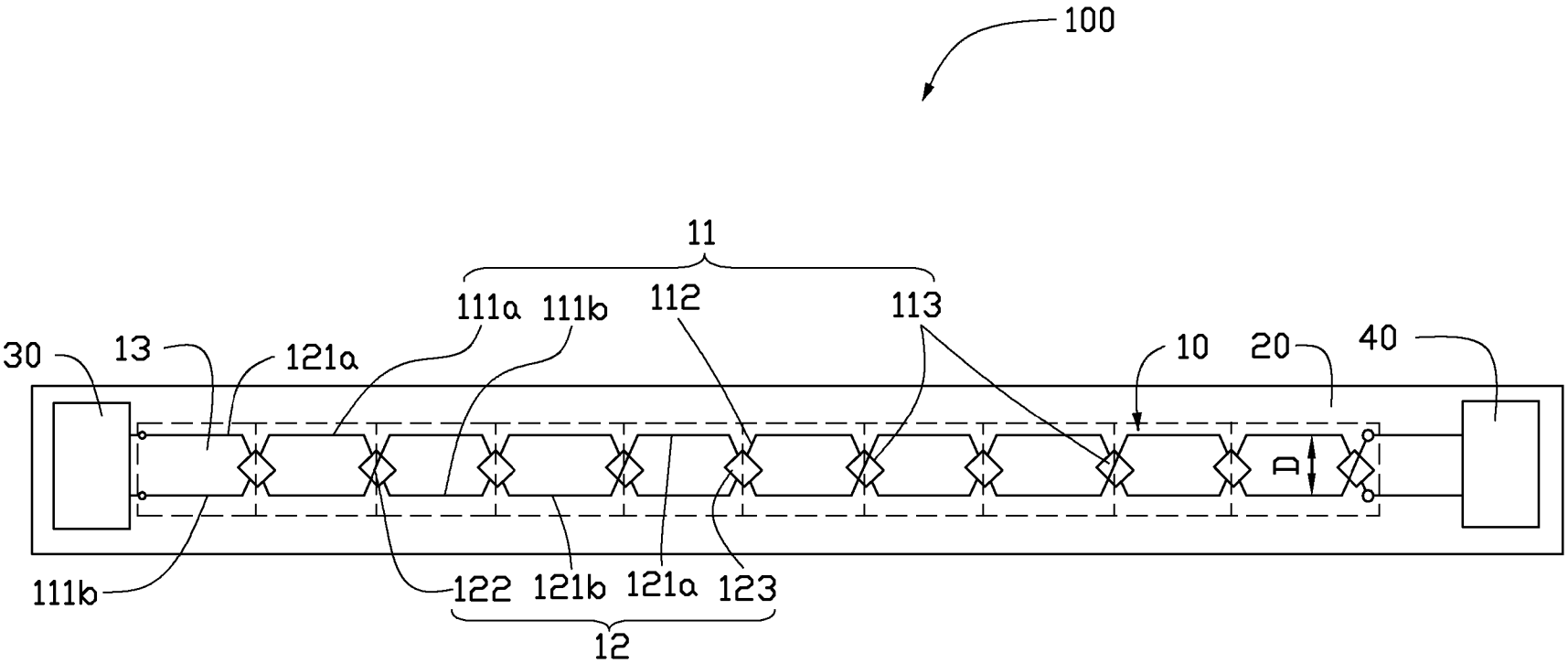
FIG. 1 is a schematic structural view of one embodiment of a detecting system.

Referring to FIG. 1, a detecting system 100 includes a high-impedance line 10, a circuit board 20, a signal detecting device 30 and a signal processing device 40. The high-impedance line 10, the signal detecting device 30, and the signal processing device 40 are disposed on the circuit board 20. One end of the high-impedance line 10 is electrically connected to the signal detecting device 30, and the other opposite end of the high-impedance line 10 is electrically connected to the signal processing device 40.

Figure 2:
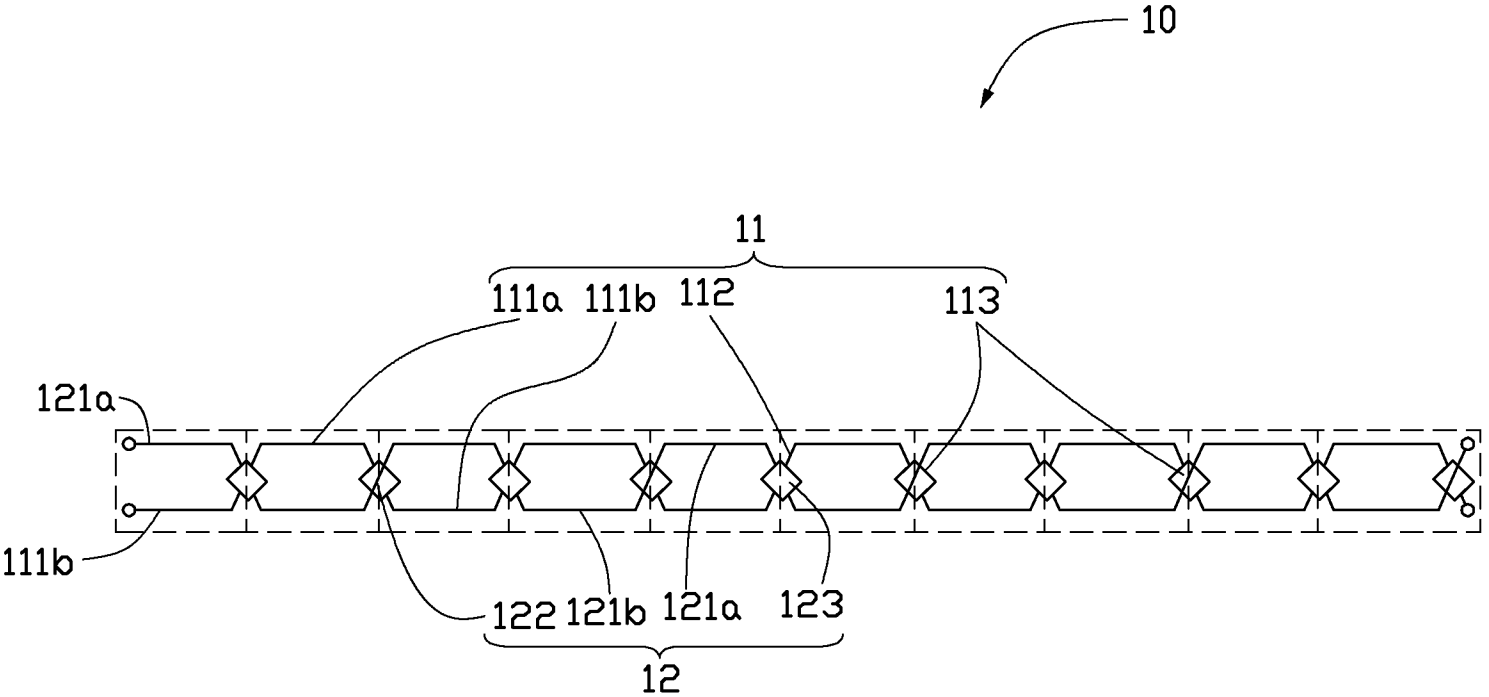
FIG. 2 is a schematic structural view of one embodiment of a high-impedance line.

Referring to FIG. 2, the high-impedance line 10 includes a first transmission line 11 and a second transmission line 12 insulated from the first transmission line 11. Both the first and second transmission lines 11 and 12 can be disposed on the circuit board 20. The first transmission line 11 can intersect with the second transmission line 12 many times to form a plurality of windings 13. In one embodiment, the high-impedance line 10 includes ten windings 13.

Figure 3:
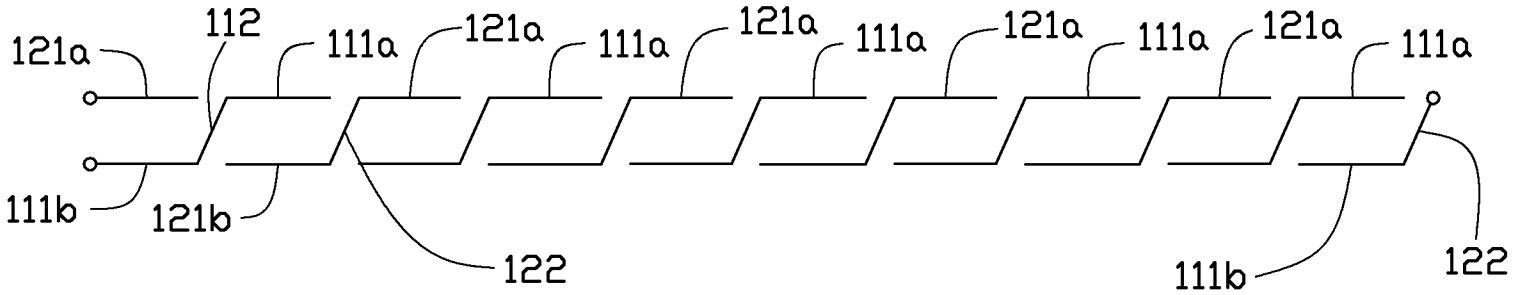
FIG. 3 is a schematic structural view of the high-impedance line, in which resistance units of the high-impedance line are not shown for clarity.
Figure 4:
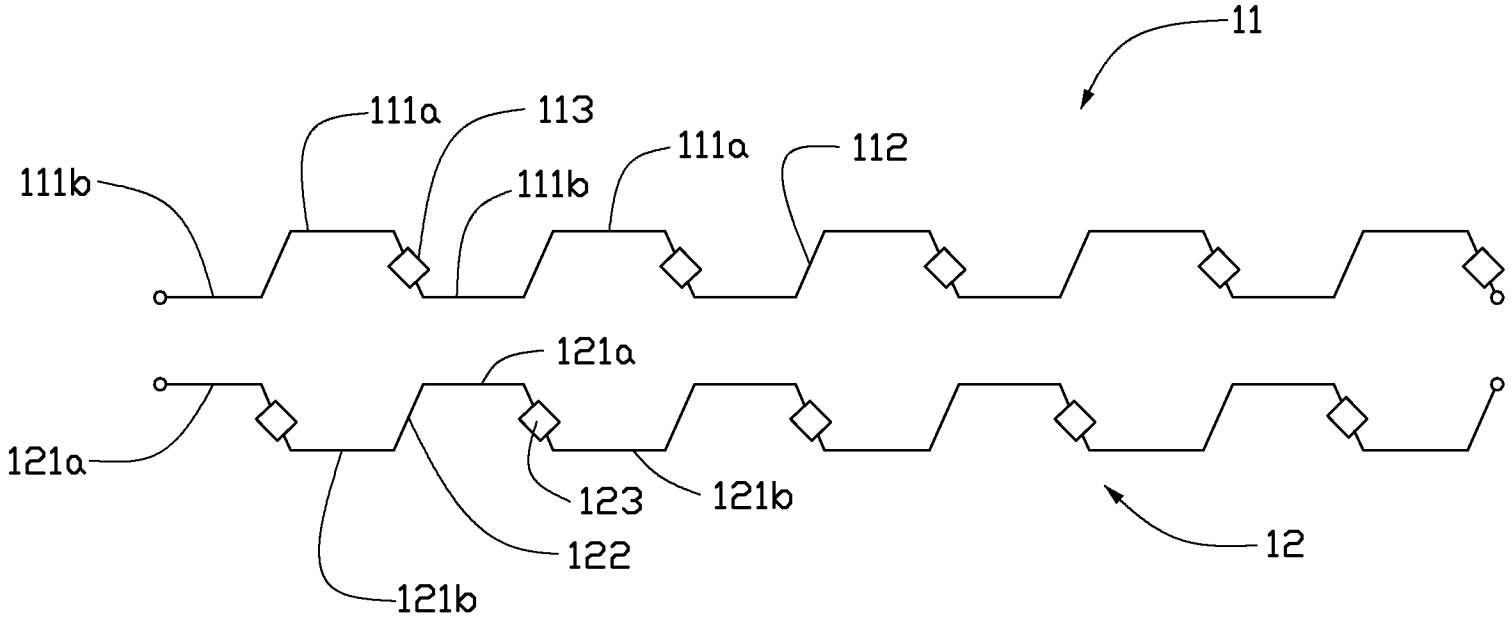
FIG. 4 is an exposed view of the high-impedance line shown in FIG. 2.

Referring to FIG. 3 and FIG. 4, the first transmission line 11 can include a plurality of first upper portions 111*a*, a plurality of first lower portions 111*b*, a plurality of first connective portions 112, and a plurality of first resistance units 113. The first upper portions 111*a* and the first lower portions 111*b* can be parallel to each other. The first upper portions 111*a* align with each other, and the first lower portions 111*b* align with each other. Two adjacent first upper portions 111*a* and first lower portion 111*b* can be electrically connected to each other by one first connective portion 112 or by one first resistance unit 113. A distance between two adjacent and disconnected first lower portions 111*b* can be larger than a length of each of the first upper and lower portions 111*a* and 111*b*. A distance between two adjacent and two disconnected first upper portions 111*a* can be larger than the length of each of the first upper and lower portions 111*a* and 111*b*. One first resistance unit 113 can replace each of the first connective portions 112. Alternatively, one first resistance unit 113 can be disposed on each of the first connective portions 112. In one embodiment, as shown in FIG. 2, about half of the first resistance units 113 are electrically connected to adjacent first upper portion 111*a* and first lower portion 111*b*, and about half of the first connective portions 112 are electrically connected to the adjacent first upper portions 111*a* and first lower portions 111*b*. The first connective portions 112 and the first resistance units 113 can be electrically connected to the first transmission line 11 alternatively. In one embodiment, the first upper portions 111*a* and the first lower portions 111*b* are substantially parallel to each other. A distance between every two adjacent first upper portions 111*a* and first lower portions 111*b* can be substantially the same.

The first upper and lower portions 111*a* and 111*b* and the first connective portions 112 can include a conductive material such as metal, conductive polymers, metallic carbon nanotubes, and indium tin oxide (ITO). In one embodiment, the conductive material is a metallic material such as gold, silver, copper. The first upper and lower portions 111*a* and 111*b* and the first connective portions 112 can have a strip shape, rod shape, bar shape, wire shape, or yarn shape. For example, the first upper and lower portions 111*a* and 111*b* and the first connective portions 112 can be metal wires, or metal strips. The first upper and lower portions 111*a* and 111*b* and the first connective portions 112 can also be metal strip shaped films or layers printed on the circuit board 20. The first upper and lower portions 111*a* and 111*b* and the first connective portions 112 can be formed by means of screen printing or spraying. A length of each of the first upper and lower portions 111*a* and 111*b* can be less than or equal to 10 millimeters. A diameter or a thickness of each of the first upper and lower portions 111*a* and 111*b* can be less than or equal to 0.2 millimeters. A resistance of each of the first resistance units 113 can be greater than or equal to 500 ohms. In one embodiment, the resistance of each of the first resistance units 113 is greater than or equal to 1000 ohms.

The second transmission line 12 can have the same structure, shape, material and size as the first transmission line 11. The second transmission 12 can include a plurality of second upper and lower portions 121*a* and 121*b*, a plurality of second connective portions 122, and a plurality of second resistance units 123. A second connective portion 122 or a second resistance unit 123 can electrically connect two adjacent second upper and lower portion 121*a* and 121*b* to each other. Referring to FIG. 2 and FIG. 3, the first upper portions 111*a* and the second lower portions 121*b* can be parallel to and correspond to each other. The first lower portions 111*b* and the second upper portions 121*a* can be parallel to and correspond to each other. The second upper and lower portions 121*a* and 121*b* can have the same structure, shape, material, length, and diameter as the first upper and lower portions 111*a*, 111*b*. The second connective portions 122 and the first connective portions 112 can be parallel to and correspond to each other. The second connective portions 122 can have the same structure, shape, material and size as the first connective portions 112. The second resistance units 123 and the first resistance units 113 can correspond to each other. The second resistance units 123 can have the same structure, shape, material, size and resistance as the first resistance units 113. The second connective portions 122 or the second resistance units 123 can intersect with the first connective portions 112 or the first resistance units 113 to form the windings 13 of the high-impedance line 10.

Each of the windings 13 can include one first upper portion 111*a* and one second lower portion 121*b* parallel to the first upper portion 111*a*, or include one first lower portion 111*b* and one second upper portion 121*a*. A distance between the first upper portion 111*a* and the second lower portion 121*b* corresponding to the same winding 13 can be less than or equal to 2 millimeters. A distance between the first lower portion 111*b* and the second upper portion 121*a* corresponding to the same winding 13 can be less than or equal to 2 millimeters. In one embodiment, the distance between the first upper portion 111*a* and the second lower portion 121*b* is less than or equal to 0.2 millimeters, and the distance between the first lower portion 111*b* and the second upper portion 121*a* is less than or equal to 0.2 millimeters. The first resistance units 113 and the second resistance units 123 can be disposed between the windings 13. A number of the first resistance units 113 can be equal to a number of the second resistance units 123; thus, a resistance of the first transmission line 11 can be equal to a resistance of the second transmission line 12. In one embodiment, the first resistance units 113 and the second resistance units 123 are alternately disposed between windings 13. A resistance of each of the windings 13 can be substantially equal to each other to ensure each of the windings 13 can have a determined resistance.

When the high-impedance line 10 is in operation and receives a radio frequency signal (RF signal), the high-impedance line 10 defines a distributed inductance and a distributed capacitance therein. The distributed inductance can be formed among the first upper and lower portions 111*a* and 111*b* and the second upper and lower portions 121*a* and 121*b*. The distributed capacitance can be formed between the first upper portions 111*a*, and the second lower portions 121*b*, or formed between the first lower portions 111*b* and the second upper portions 121*a*.

Figure 5:
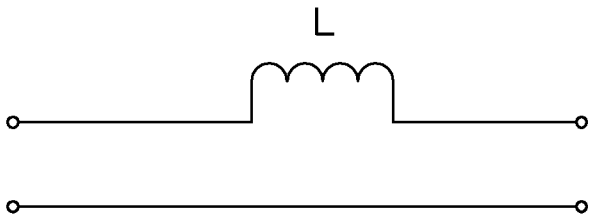
FIG. 5 is an equivalent circuit diagram of a distributed inductance connected to the high-impedance line.

An equivalent circuit diagram of the distributed inductance, and the first upper and lower portions 111*a* and 111*b* and the second upper and lower portions 121*a*, 121*b* can be shown in FIG. 5. An inductance of the distributed inductance can be defined as L, and a frequency of the RF signal can be defined as ω, a reactance formed by the distributed inductance can be shown by the formula Z=jωt. Thus, the greater the frequency ω of the RF signals, the greater the reactance Z formed by the distributed inductance, and the greater the impedance of the high-impedance line 10.

Figure 6:
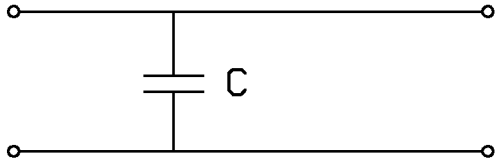
FIG. 6 is an equivalent circuit diagram of a distributed capacitance connected to the high-impedance line.

An equivalent circuit diagram of the distributed capacitance, and the first upper portions 111*a* and the second lower portions 121*b* can be shown in FIG. 6. An capacitance of the distributed inductance can be defined as C; a reactance Z formed by the distributed capacitance can be shown by the formula $$Z = \frac{1}{j\omega C}.$$

Thus, the greater the frequency ω of the RF signals, the less the reactance Z formed by the distributed capacitance, and the greater the impedance of the high-impedance line 10.

Figure 7:
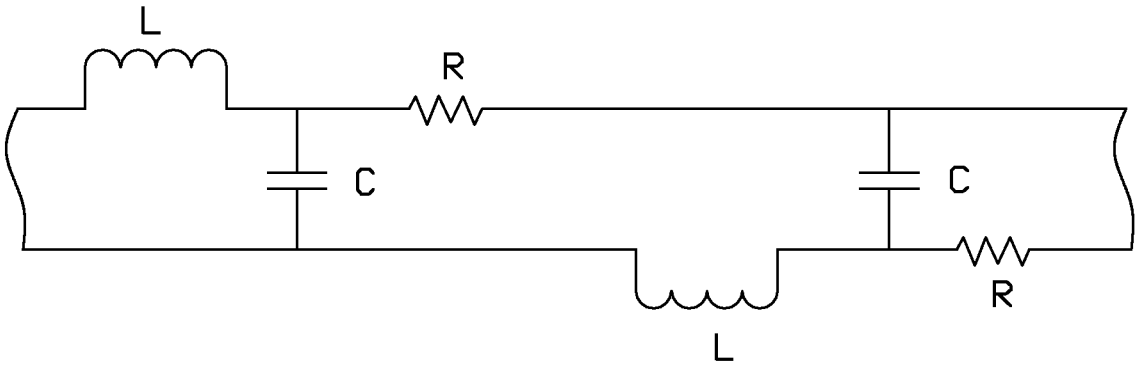
FIG. 7 is an equivalent circuit diagram of the high-impedance line.

An equivalent circuit diagram of the high-impedance line 10 can be shown in FIG. 7. The impedance of the high-impedance line 10 formed by the distributed inductances, the distributed capacitances, the first resistance units 113, and the second resistance units 123, can be increased with the frequency ω of the RF signal. Thus, the high-impedance line 100 can be capable of shielding high frequency signals in RF signals. In one embodiment, the high-impedance line 100 is capable of shielding signals with a frequency substantially greater than 850 MHZ.

The circuit board 20 can be configured for fixing the high-impedance line 10. The first upper and lower portions 111*a* and 111*b*, the second upper and lower portions 121*a* and 121*b* and the first and second connective portions 121 and 122 can be fixed on the circuit board 20 by means of printing or welding. The first and second resistance units 113 and 123 can be fixed on the circuit board 20 by means of welding or adhering. The circuit board 20 can be a panel or a printed circuit board (PCB). In one embodiment, the circuit board 20 is the PCB. The PCB can provide electrical connection among the high-impedance line 100 and other electrical elements such as the signal detecting device 30, and the signal processing device 40.

The signal detecting device 30 can be configured for detecting RF signals and inputting the RF signals to the high-impedance line 10. The high-impedance line 10 can converted the RF signals to signal envelops. The signal detecting device 30 can be a Hearing Aid Compatibility (HAC) probe or a detecting device detecting RF signals.

The signal processing device 40 can be configured for receiving signal envelopes converted by the high-impedance line 10. The signal processing device 40 can be an Analog-digital converter (ADC), a central processing unit (CPU) or other data-processing equipment.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A high-impedance line, comprising:

a plurality of windings successively arranged, each of the windings comprising an upper portion and a lower portion parallel to the upper portion; the upper portions of each of the windings being electrically connected to the lower portions of adjacent windings; and a plurality of resistance units, each of the plurality of resistance units being electrically connected between two adjacent windings.

2. The line as claimed in claim 1, wherein a length of each of the upper portions is less than or equal to 10 millimeters, and a length of each of the lower portions is less than or equal to 10 millimeters.

3. The line as claimed in claim 1, wherein a diameter of each of the upper portions is less than or equal to 0.2 millimeters, and a diameter of each of the lower portions is less than or equal to 0.2 millimeters.

4. The line as claimed in claim 1, wherein in each of the windings, a distance between the upper portion and the lower portion is less than or equal to 2 millimeters.

5. The line as claimed in claim 1, wherein the upper portions are substantially collinear, and the lower portions are substantially collinear.

6. The line as claimed in claim 1, further comprising a first connective portion electrically connected between every two adjacent windings.

7. The line as claimed in claim 6, wherein in each two adjacent windings, two adjacent upper portion and lower portion are connected with one resistance unit, and the other two adjacent upper portion and lower portion are connected with one connective portion.

8. The line as claimed in claim 1, wherein a resistance of each of the plurality of resistance units is greater than 500 ohms.

9. The line as claimed in claim 1, wherein about half of the amount of the upper portions are electrically connected with about half of the amount of the lower portions to define a first transmission line, the other upper portions are electrically connected with the other lower portions to define a second transmission line; in each two adjacent resistance units, one of the two adjacent resistance units is electrically connected to the first transmission line, and the other one of the two adjacent resistance units is electrically connected to the second transmission line.

10. The line as claimed in claim 9, wherein the resistance units electrically connected to the first transmission line and the resistance units electrically connected to the second transmission line are alternatively arranged.

11. The line as claimed in claim 9, wherein the number of the resistance units electrically connected to the first transmission line is equal to the number of the resistance units electrically connected to the second transmission line.

12. A high-impedance line, comprising:

a first transmission line;

a second transmission line intersected with the first transmission line to form more than two windings; and a resistance unit electrically connected between two adjacent windings.

13. The line as claimed in claim 12, wherein a resistance of the first transmission line is substantially equal to a resistance of the second transmission line.

14. The line as claimed in claim 12, wherein one resistance unit of two adjacent resistance units is electrically connected to the first transmission line, and the other resistance unit of the two adjacent resistance units is electrically connected to the second transmission line.

15. The line as claimed in claim 12, wherein the first transmission line comprises a plurality of first portions; a first connective portion connects two adjacent first portions; the second transmission line comprises a plurality of second portions; a second connective portion connects two adjacent second portions; each of the first connective portions intersects one second connective portion.

16. A detecting system, comprising:

a signal detecting device for detecting RF signals;

a signal processing device; and a high-impedance line electrically connected to the signal detecting device and the signal processing device, the high-impedance line comprising a plurality of windings successively arranged;

wherein each of the windings comprises a first portion and a second portion; the first portions of two adjacent windings are electrically connected to each other via a first resistance unit; the second portions of two adjacent windings are electrically connected to each other via a second resistance unit.

* * * * *